US008358181B2

(12) United States Patent
Shimamura

(10) Patent No.: US 8,358,181 B2
(45) Date of Patent: Jan. 22, 2013

(54) SUBSTRATE ATTENUATOR CIRCUIT

(75) Inventor: Naoki Shimamura, Iwaki (JP)

(73) Assignee: Alpine Electronics, Inc., Tokyo (JP)

( * ) Notice: Subject to any disclaimer, the term of this patent is extended or adjusted under 35 U.S.C. 154(b) by 356 days.

(21) Appl. No.: 12/893,523

(22) Filed: Sep. 29, 2010

(65) Prior Publication Data

US 2011/0163829 A1 Jul. 7, 2011

(30) Foreign Application Priority Data

Jan. 7, 2010 (JP) ..... 2010-002203

(51) Int. Cl.
*H01P 1/22* (2006.01)

(52) U.S. Cl. ..... 333/81 A; 333/81 R

(58) Field of Classification Search ..... 333/81 A, 333/81 R

See application file for complete search history.

(56) References Cited

U.S. PATENT DOCUMENTS 4,146,854 A * 3/1979 Ishino et al. ..... 333/81 R

FOREIGN PATENT DOCUMENTS

JP 05-021202 1/1993
JP 05-021203 1/1993

* cited by examiner

*Primary Examiner* — Stephen Jones
(74) *Attorney, Agent, or Firm* — Brinks Hofer Gilson & Lione

(57) ABSTRACT

Disclosed is a substrate attenuator circuit having a thin, long conductive pattern with a plurality of bends on a substrate, with heat generation per unit area reduced to a small amount even at a low attenuation level. A linear conductive pattern configured to have a plurality of bends on a substrate is provided with output terminals at n portions thereof. The conductive pattern has a larger line width at a first stage conductive pattern portion defined in a portion from an input terminal to m output terminals (m<n) than the line widths of the conductive pattern portions defined in the remaining portion, the m output terminals being disposed closer to the input terminal of the output terminals of the n portions. The first stage conductive pattern portion is thus increased in conductor area, and heat generation per unit area is reduced to a small amount even when only the first stage conductive pattern portion is used to obtain a low attenuation level.

11 Claims, 7 Drawing Sheets

SUBSTRATE ATTENUATOR CIRCUIT

RELATED APPLICATIONS

This application is based on Japanese Patent Application No. 2010-002203 filed on Jan. 7, 2010, the entire content of which is hereby incorporated by reference.

BACKGROUND OF THE INVENTION

1. Field of the Invention

The embodiments discussed herein relate to attenuator circuits provided on substrates (hereinafter "substrate attenuator circuits"). In particular, the embodiments are suitably applicable to attenuator circuits configured on substrates with thin, long conductive patterns having multiple bends.

2. Description of the Related Art

Conventionally provided attenuator circuits include one configured on a substrate with a resistive film having a thin, long conductive pattern bent at multiple portions (see, e.g., JP-A-05-021202). According to the technique described in JP-A-05-021202, an input terminal is provided at one end of the thin, long continuous conductive pattern, and output terminals are drawn out from a plurality of portions of the conductive pattern, such that desired resistance values are available therefrom.

FIG. 7 illustrates an exemplary configuration of the above-mentioned related art. In FIG. 7, a thin, long conductive pattern 101 of a uniform width is configured on a substrate 100 so as to have a folding pattern including multiple bends at an angle of 180 degrees. An input terminal 102 is provided at one end of the conductive pattern 101, and a plurality of output terminals 103A to 103C are drawn out from a plurality of portions of the conductive pattern 101.

Signals output from the first output terminal 103A are attenuated by a first resistance value corresponding to a conductive pattern portion 101A that is defined from the input terminal 102 to the first output terminal 103A. Signals output from the second output terminal 103B are attenuated by a second resistance value corresponding to the conductive pattern portion 101A and a conductive pattern portion 101B that are defined from the input terminal 102 to the second output terminal 103B. Signals output from the third output terminal 103C are attenuated by a third resistance value corresponding to the conductive pattern portions 101A and 101B and a conductive pattern portion 101C that are defined from the input terminal 102 to the third output terminal 103C. With this configuration, signals may be extracted from any of the output terminals 103A to 103C appropriately selected, and signals input to the input terminal 102 are thus attenuated for output by a desired level.

However, of the entire conductor area provided by the conductive pattern, the smaller the resistance value, i.e., the lower the attenuation level, to be attained by a conductive pattern portion defined from the input terminal to an output terminal, the smaller the conductor area to be used to provide that resistance value is. For this reason, a lower attenuation level entails increased power consumption per unit area, hence an increased amount of heat generation per unit area.

SUMMARY

The present invention was made in view of the foregoing problems, and it is an object of the invention to provide an attenuator circuit configured on a substrate with a thin, long conductive pattern having a plurality of bends, in which attenuator circuit the amount of heat generation per unit area is suppressed from growing extremely large even at a low attenuation level.

To achieve the above object, according to an embodiment of the present invention, a linear conductive pattern is configured with a plurality of bends on a substrate, and output terminals are disposed at n locations (n is an integer of two or larger) of the conductive pattern between the ends thereof. The conductive pattern has a larger line width in a portion from an input terminal to m output terminals (m is a positive integer smaller than n) than a line width of a remaining conductive pattern portion, the m output terminals being disposed at a side closer to the input terminal of the output terminals of the n locations.

According to the embodiment configured as above, a smaller resistance value, thus a lower signal attenuation level, is provided from the conductive pattern defined in a portion from the input terminal to m output terminals that is disposed at a side closer to the input terminal. Since the conductive pattern portion to provide the smaller resistance value has a larger line width, that portion is increased in conductor area. Accordingly, power consumption per unit area, thus heat generation per unit area, is held to a small amount even when obtaining a low attenuation level.

The foregoing and other objects, features, aspects and advantages of the invention will become more apparent from the following detailed description when taken in conjunction with the accompanying drawings.

DESCRIPTION OF THE PREFERRED EMBODIMENTS

First Embodiment

Figure 1:
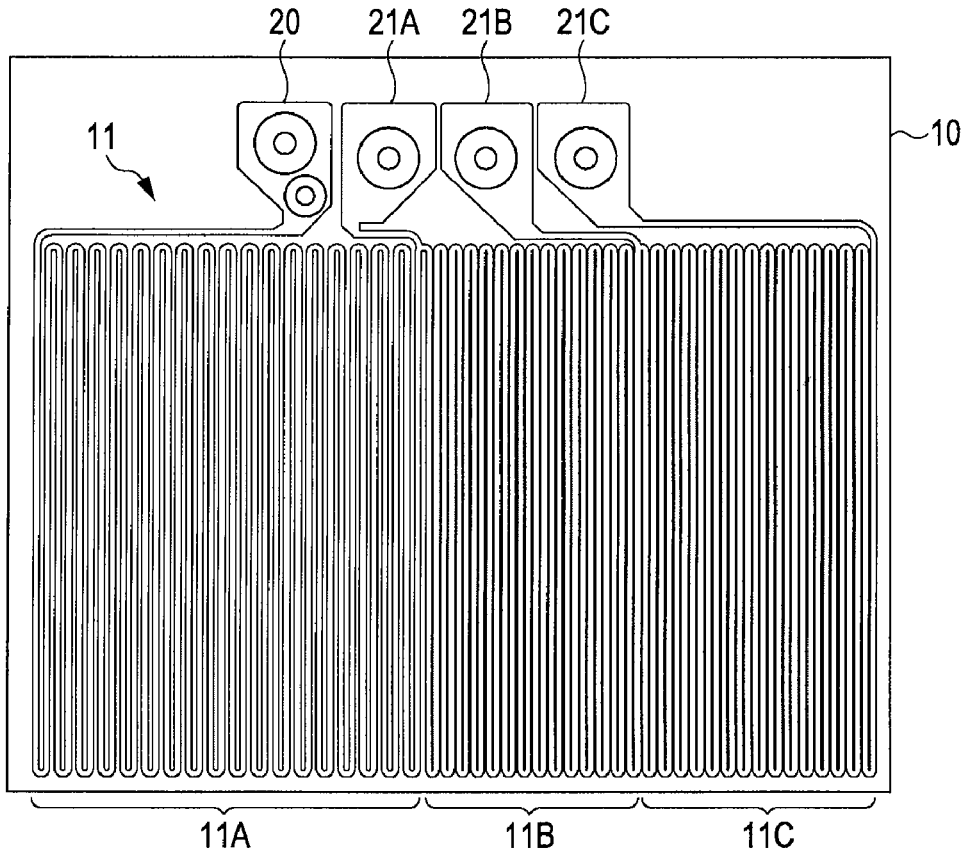
FIG. 1 illustrates an exemplary configuration of a substrate attenuator circuit according to a first embodiment of the present invention.

An embodiment of the present invention is described below with reference to the drawings. FIG. 1 illustrates an exemplary configuration of a substrate attenuator circuit according to a first embodiment of the present invention. In FIG. 1, a thin and long, linear conductive pattern 11 is formed on a substrate 10. The conductive pattern 11 is bent by an angle of 180 degrees at multiple portions to form a folding pattern.

An input terminal 20 is provided at one end of the conductive pattern 11. Output terminals 21A to 21C are drawn out from n locations (n is an integer of two or larger; n=3 in the example illustrated in FIG. 1) of the conductive pattern 11. In the present embodiment, the output terminals 21A to 21C of the n locations are disposed in k stages (k=1, 2, . . . n) sequentially from a stage proximate to the input terminal 20. The output terminal at the n-th stage (hereinafter "an n-th stage output terminal") is provided at the terminal end of the conductive pattern 11. The conductive pattern in a portion from the input terminal 20 to the first stage output terminal 21A is defined as a first stage conductive pattern 11A, the conductive pattern in a portion from the first stage output terminal 21A to the second stage output terminal 21B is defined as a second stage conductive pattern 11B, and the conductive pattern in a portion from the second stage output terminal 21B to the third stage output terminal 21C is defined as a third stage conductive pattern 11C.

The signals output from the first stage output terminal 21A are attenuated by a first resistance value corresponding to the first stage conductive pattern 11A that exists from the input terminal 20 to the first stage output terminal 21A. The signals output from the second stage output terminal 21B are attenuated by a second resistance value corresponding to the first stage conductive pattern 11A and the second stage conductive pattern 11B that exist from the input terminal 20 to the second stage output terminal 21B. The signals output from the third stage output terminal 21C are attenuated by a third resistance value corresponding to the first to third stage conductive patterns 11A to 11C that exist from the input terminal 20 to the third stage output terminal 21C. In this configuration, signals may be extracted from any of the output terminals 21A to 21C appropriately selected, such that signals input to the input terminal 20 are attenuated for output by a desired level.

In the present embodiment, the conductive pattern 11 has a larger line width in a portion from the input terminal 20 to an output terminal or output terminals of m portion(s) (m is a positive integer smaller than n) than the line width of the conductive pattern 11 in the remaining portion, the output terminal(s) of the m portion(s) being disposed on a side closer to the input terminal 20 of the output terminals 21A to 21C of the n locations. FIG. 1 illustrates an example in which m is 1, i.e., the first stage conductive pattern 11A defined in a portion from the input terminal 20 to the first stage output terminal 21A has a larger line width than the line width of the second and third stage conductive patterns 11B and 11C in the remaining portion.

An increased line width of the first stage conductive pattern 11A provides an increased conductor area of the first stage conductive pattern 11A. Power consumption (heat generation) per unit area is thereby held to a small amount even in the case of obtaining a small resistance value from the first stage conductive pattern 11A that is defined in a portion from the input terminal 20 to the output terminal 21A relatively close to the input terminal 20.

Figure 2:
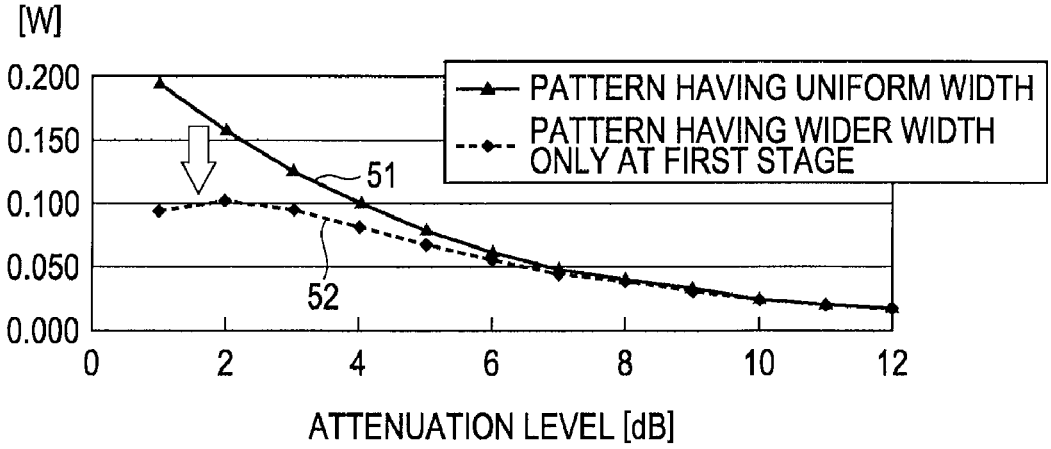
FIG. 2 illustrates a relationship between attenuation levels and power consumption per unit area.

FIG. 2 illustrates a relationship between n attenuation levels obtainable with output terminals provided at n locations of the conductive pattern 11, and power consumption per unit area. FIG. 2 illustrates an example in which n is 12. The graph denoted by the numeral 51 shows properties in a case of forming the first to twelfth stage conductive patterns to have an equal line width. Meanwhile, the graph denoted by the numeral 52 shows properties in a case of forming the second to twelfth stage conductive patterns to have the same line width as that of the graph 51 but forming the first stage conductive pattern to have a larger line width than the line width of the second to twelfth stage conductive patterns.

As shown by the graph 51, in the case of the first to twelfth stage conductive patterns having an equal line width, the power consumed per unit area is increased as the attenuation levels obtainable by the resistance values of the conductive patterns get smaller. This is because a lower attenuation level involves a smaller resistance value, thus involving a smaller conductor area to provide that resistance value.

Meanwhile, in the case of the conductive patterns with the first stage conductive pattern having a larger line width than the line width of the conductive patterns in the remaining portion, as shown by the graph 52, power consumption per unit area is reduced to smaller amounts at lower attenuation levels. Although the first stage conductive pattern alone has a larger line width in this example, power consumption per unit area is reduced to smaller amounts not only at the lowest attenuation level of the first stage but also at the attenuation levels from the second to around fifth stages.

This is because the resistance value of the first stage conductive pattern with a larger line width is used to obtain the attenuation levels from the second to fifth stages, and the first stage conductive pattern has a comparatively large portion of the total conductor area provided by the first to fifth stage conductive patterns. Accordingly, providing a larger line width in the first stage conductive pattern enables the peak heat generation to be reduced effectively with a minimum increase in substrate area.

Figure 3:
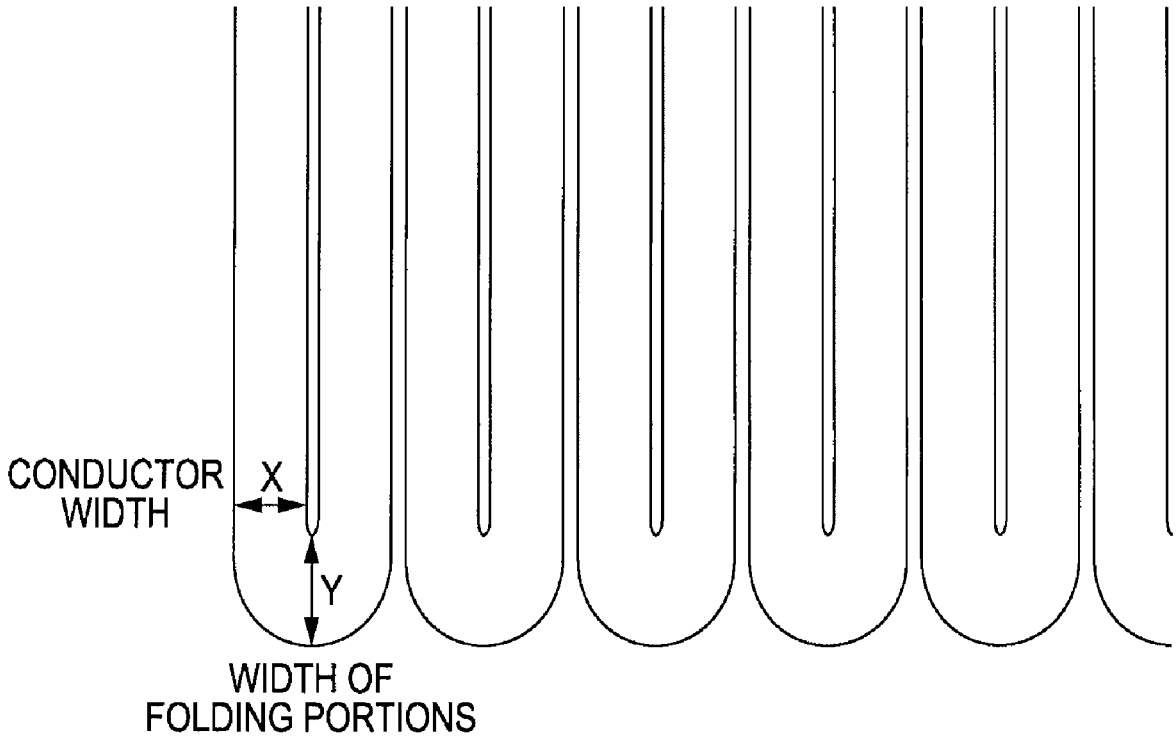
FIG. 3 illustrates an exemplary configuration of folding portions of a conductive pattern according to the first embodiment.

FIG. 3 illustrates an exemplary configuration of the folding portions of the conductive pattern 11. As illustrated in FIG. 3, straight, linear portions of the conductive pattern 11 have a line width X, and the folding portions of the conductive pattern 11 have a line width Y. The folding portions are apt to have uneven widths due to variability in pattern forming, leading to variation of overall resistance values. Setting Y>X, preferably Y>>X, enables resistance values at the folding portions to be held as small as possible and reduces the effect of errors among the resistance values caused by variation of widths at the folding portions. Accordingly, variation of overall resistance values is reduced significantly.

As described in detail above, according to the first embodiment, the conductive pattern 11A to provide a small resistance value (a low attenuation level) in a portion from the input terminal 20 to the first stage output terminal 21A is provided with a larger line width than the line width of the conductive patterns 11B and 11C in the remaining portion. Thus, even for obtaining a low attenuation level, the conductive pattern 11A used therefor has an increased conductor area, with the result of reduced heat generation amount per unit area. A highly reliable substrate attenuator circuit is thereby provided.

According to the first embodiment, a description has been given of an example in which the first stage conductive pattern 11A has a larger line width than that of the remaining portion, the first stage conductive pattern 11A being defined in a portion from the input terminal 20 to the first stage output terminal 21A proximate to the input terminal 20. The above example is given only for an illustrative purpose, however. That is, the conductive pattern may have a larger line width in a portion from the input terminal 20 to an m-th stage ($2 \leqq m < n$) output terminal than the line width in the remaining portion.

In this case, the conductive pattern may have a uniform line width in the portion from the input terminal 20 to the m-th stage ($2 \leqq m < n$) output terminalor, alternatively, the k-th stage conductive pattern may have a larger line width than the line width of a (k+1)-th stage conductive pattern. For example, as a variation of the substrate attenuator circuit illustrated in FIG. 1, line widths may be set such that (the line width of the first stage conductive pattern 11A)>(the line width of the second stage conductive pattern 11B)>(the line width of the third stage conductive pattern 11C).

Further, in a portion from the input terminal 20 to an m-th stage output terminal ($1 \leqq m < n$), the conductive pattern may have line widths that are gradually increased in accordance with the proximity to the input terminal 20. For example, as a variation of the substrate attenuator circuit illustrated in FIG. 1, the straight, linear portion proximate to the input terminal 20 of the first stage conductive pattern 11A may have the largest line width, the line width may be gradually reduced as the conductive pattern is folded, and a straight, linear portion farthest from the input terminal 20 of the second stage conductive pattern 11B may have a line width approximately equal to the line width of the third stage conductive pattern 11C.

Second Embodiment

Figure 4:
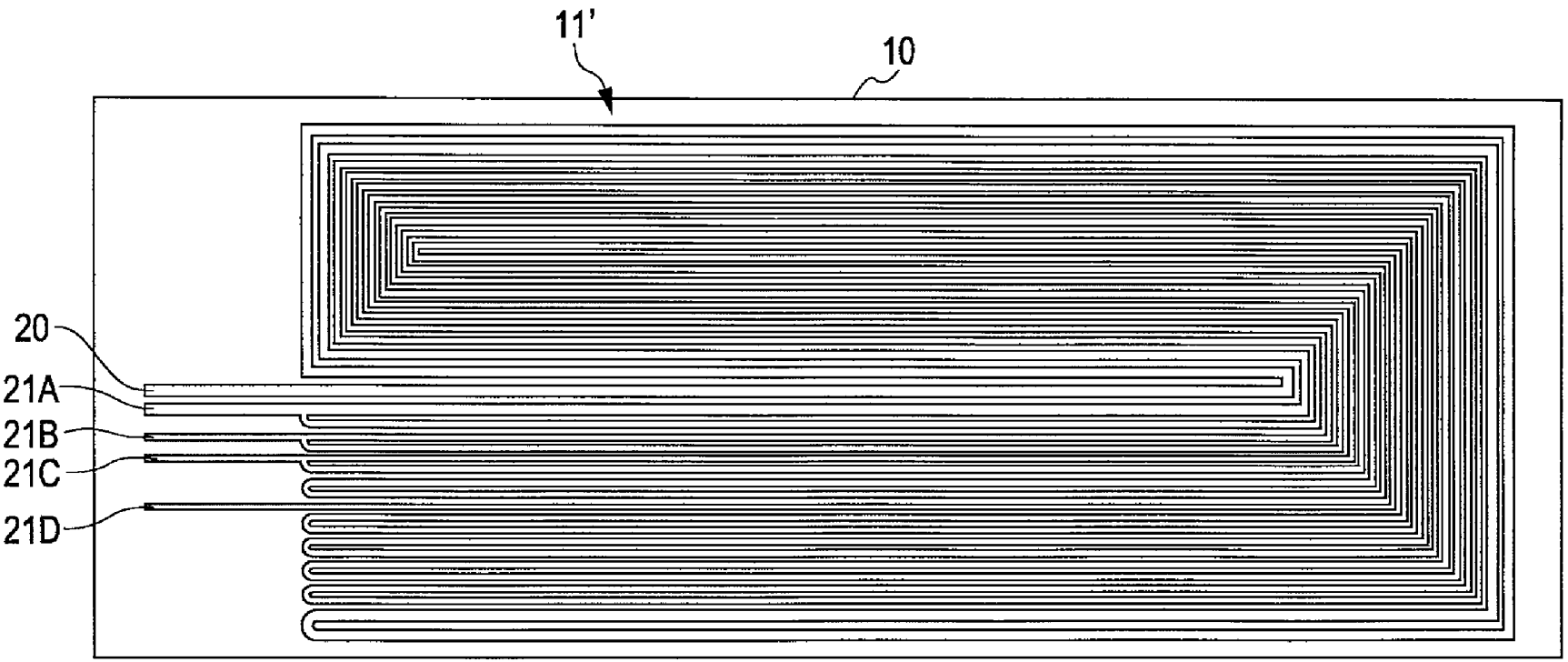
FIG. 4 illustrates an exemplary configuration of a substrate attenuator circuit according to a second embodiment of the present invention.

Next, a second embodiment of the present invention is described with reference to the drawings. FIG. 4 illustrates an exemplary configuration of a substrate attenuator circuit according to the second embodiment. In the second embodiment, the conductive pattern has a larger line width in a portion from the input terminal 20 to an output terminal 21A of m portion (e.g., m=1) than the line width of the remaining portion, the output terminal 21A being disposed relatively close to the side to the input terminal 20; in addition, a k-th stage (k=1, 2, . . . n−1) conductive pattern is disposed to surround the (k+1)-th stage conductive pattern.

FIGS. 5A to 5D illustrate a conductive pattern 11' configured as illustrated in FIG. 4, wherein the configuration of each of the n-th stage (n=1, 2, 3, 4) conductive patterns 11A' to 11D' is shown in a more understandable manner. As illustrated in FIGS. 5A to 5D, an input terminal 20 is disposed at an approximately central portion of a side of a rectangular region having the conductive pattern 11' formed therein. Four output terminals 21A to 21D are drawn out from that side (the side to which the input terminal 20 is provided) of the rectangular region.

Figure 5A:
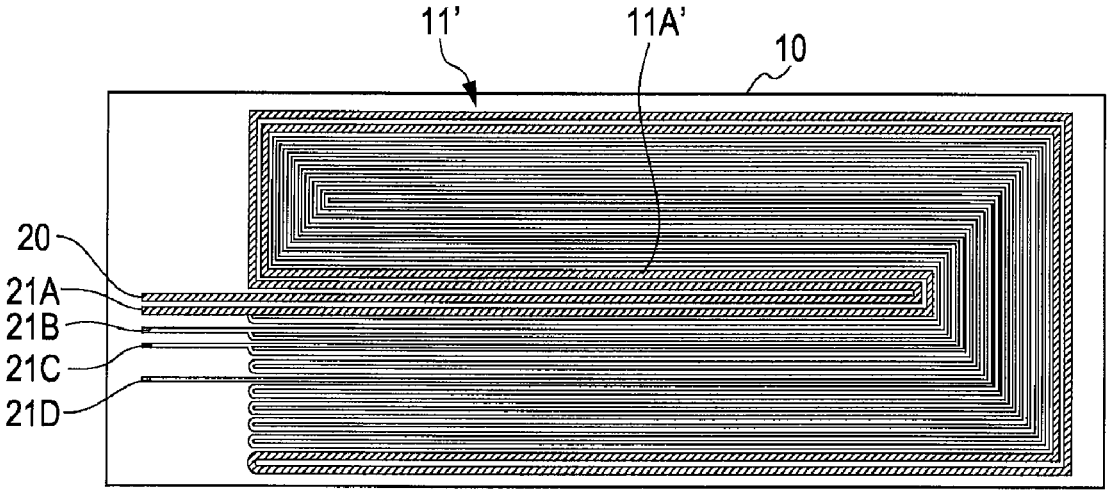
FIG. 5A illustrates a conductive pattern at a first stage according to the second embodiment.

As illustrated in FIG. 5A, the first stage conductive pattern 11A' runs from the input terminal 20 disposed at the approximately central portion through the innermost portion of the rectangular region, through which the conductive pattern 11A' folds back at an angle of 180 degrees. The conductive pattern 11A' thereafter proceeds along the four sides of the rectangular region while turning at an angle of 90 degrees, but only halfway on the side where the input terminal 20 and the output terminals 21A to 21D are provided, so as to pass over the outermost periphery of the rectangular region. This is referred to as an outward path. The first stage conductive pattern 11A' then folds back at 180 degrees from the tip of the outward path alongside the outward path to the aforementioned side of the rectangular region. An inward path is formed from the tip of the outward path at which the conductive pattern 11A' turns up to the returning point on the aforementioned side of the rectangular region. The first stage output terminal 21A is drawn out from the tip of the inward path.

Figure 5B:
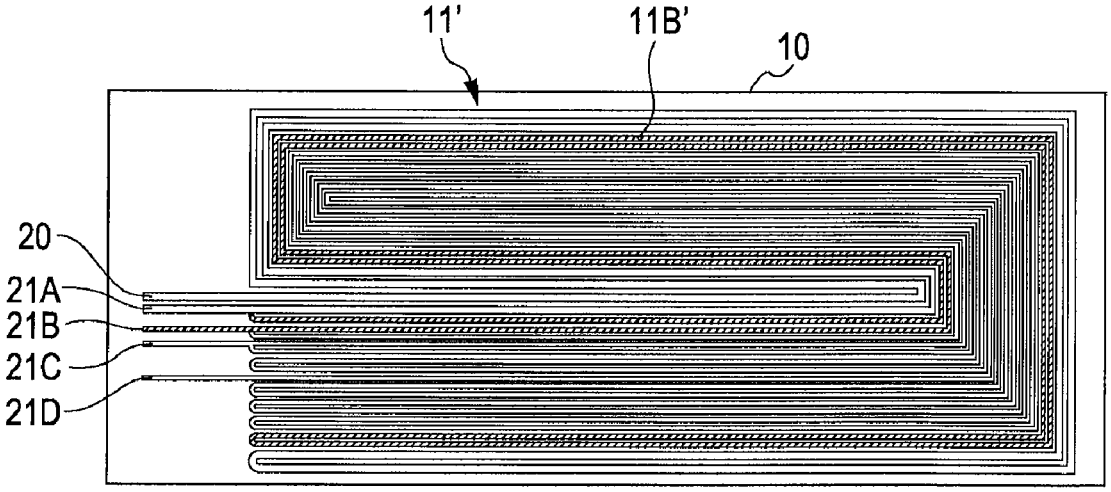
FIG. 5B illustrates the conductive pattern at a second stage according to the second embodiment.

As illustrated in FIG. 5B, the second stage conductive pattern 11B' starts with a 180 degrees turn at the tip of the inward path of the first stage conductive pattern 11A'. The second stage conductive pattern 11B' is constituted by an outward path and an inward path that are adjacent to the first stage conductive pattern 11A'. More specifically, in an inner portion of the rectangular region, the second stage conductive pattern 11B' proceeds alongside the first stage conductive pattern 11A' on the outer side thereof. On the outer periphery of the rectangular region, the second stage conductive pattern 11B' proceeds alongside the first stage conductive pattern 11A' on the inner side thereof. The second stage output terminal 21B is drawn out from the tip of the inward path of the second stage conductive pattern 11B'.

Figure 5C:
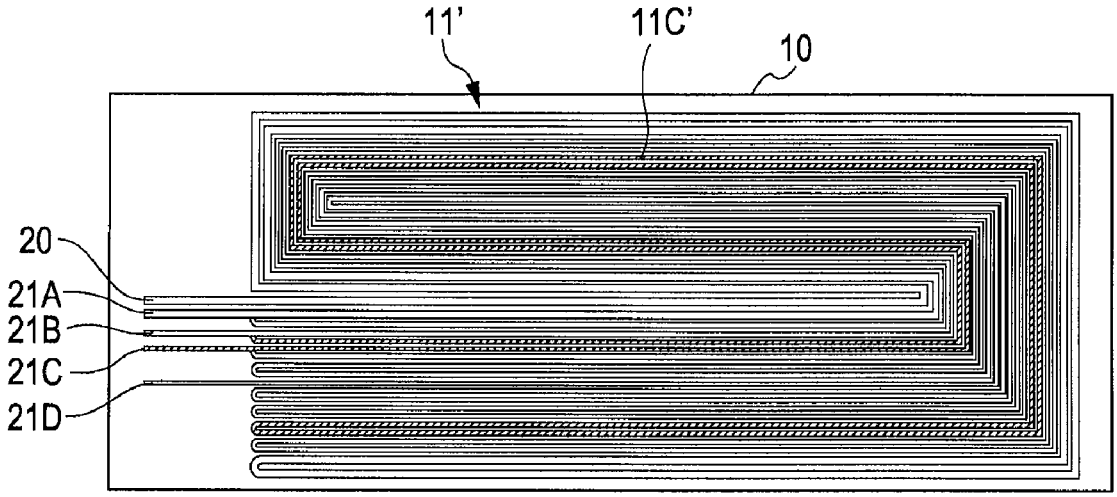
FIG. 5C illustrates the conductive pattern at a third stage according to the second embodiment.

As illustrated in FIG. 5C, the third stage conductive pattern 11C' starts with a 180 degrees turn at the tip of the inward path of the second stage conductive pattern 11B'. The third stage conductive pattern 11C' is constituted by an outward path and an inward path that are adjacent to the second stage conductive pattern 11B'. More specifically, in the inner portion of the rectangular region, the third stage conductive pattern 11C' proceeds alongside the second stage conductive pattern 11B' on the outer side thereof. On the outer periphery of the rectangular region, the third stage conductive pattern 11C' proceeds alongside the second stage conductive pattern 11B' on the inner side thereof. The third stage output terminal 21C is drawn out from the tip of the inward path of the third stage conductive pattern 11C'.

Figure 5D:
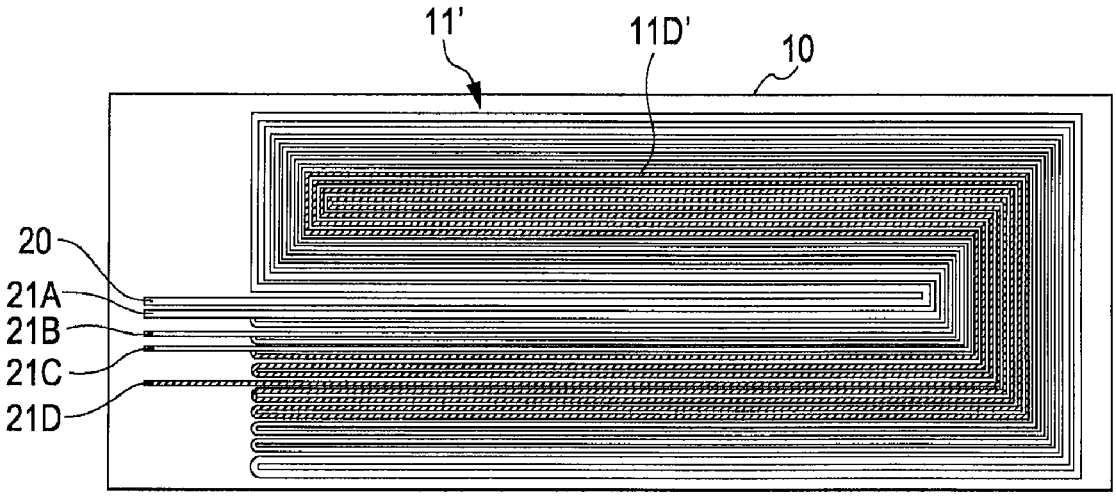
FIG. 5D illustrates the conductive pattern at a fourth stage according to the second embodiment.

As illustrated in FIG. 5D, the fourth stage conductive pattern 11D' starts with a 180 degrees turn at the tip of the inward path of the third stage conductive pattern 11C'. The fourth stage conductive pattern 11D' is constituted by outward paths and inward paths that are adjacent to the third stage conductive pattern 11C'. More specifically, in the inner portion of the rectangular region, the fourth stage conductive pattern 11D' proceeds alongside the third stage conductive pattern 11C' on the outer side thereof. On the outer periphery of the rectangular region, the fourth stage conductive pattern 11D' proceeds alongside the third stage conductive pattern 11C' on the inner side thereof. The fourth stage conductive pattern 11D' has two outward paths and two inward paths. The fourth stage output terminal 21D is drawn out from the tip of an inward path of the fourth stage conductive pattern 11D'.

According to the technique described in JP-A-05-021202 mentioned in the background section, a portion of the conductive pattern to be used to obtain a low attenuation level is confined to a local region of the rectangular region containing the conductive pattern formed therein. Because of this configuration, the heat source is concentrated at the local region, resulting in reduced electric power durability. On the other hand, according to the second embodiment configured as above, even in the case where merely a portion of the conductive pattern is used to obtain a low attenuation level, the conductive pattern portion used is defined in distributed regions, i.e., the inner portion and the outer peripheral portion of the rectangular region, as illustrated in FIG. 5A. Dissipation of the heat source, and thus higher electrical power durability, are thereby achieved.

Further, according to the technique described in JP-A-05-021202 mentioned in the background section, since the conductive pattern is bent at an angle of 180 degrees in all folding portions, inductive components develop at the folding portions. In a case of applying the substrate attenuator circuit to an audio system, the quality of sound reproduced may be adversely affected by the inductive components. On the other hand, according to the second embodiment, the number of portions folded at 180 degrees is significantly reduced in the conductive pattern, which provides improvement in the reproduced sound quality. Moreover, according to the second embodiment, the input terminal 20 and the drawn-out portions of the plurality of output terminals 21A to 21D are advantageously disposed in positions relatively close to one another.

Figure 6:
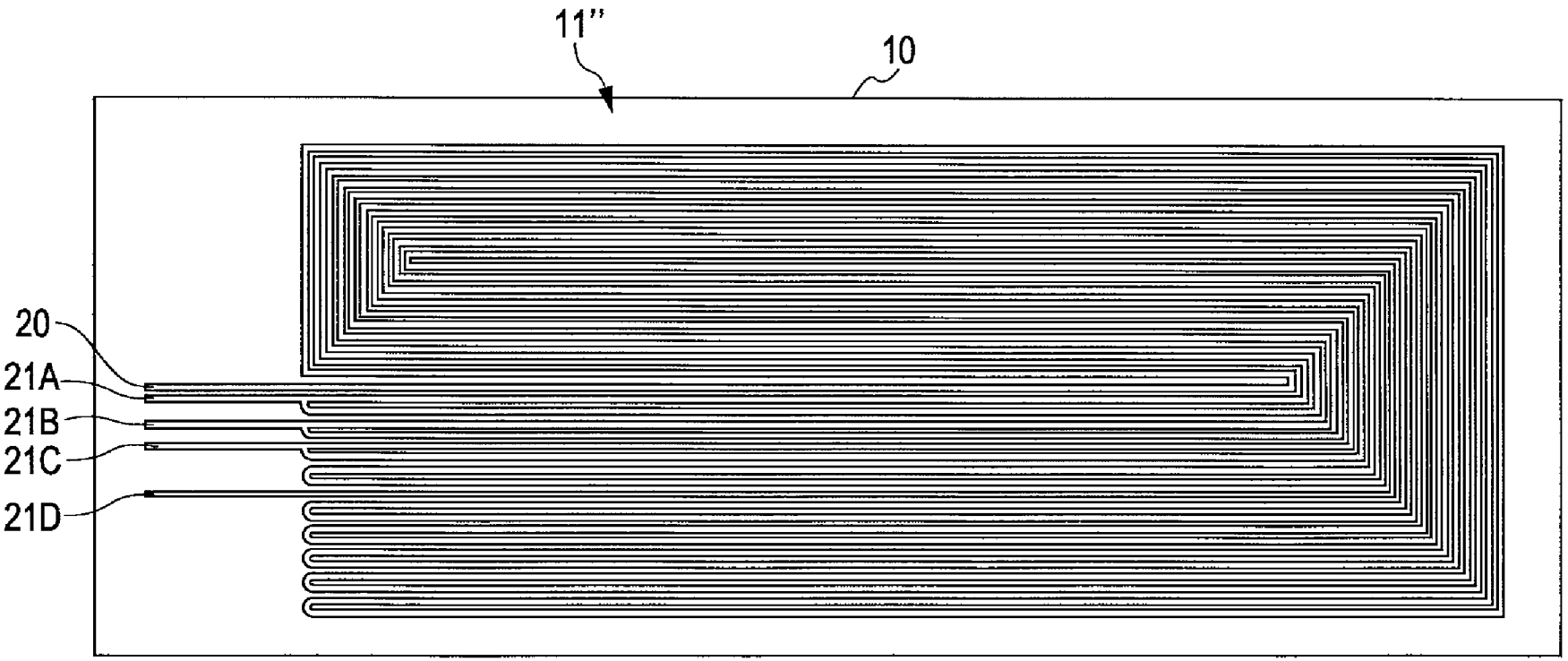
FIG. 6 illustrates a variation of the substrate attenuator circuit according to the second embodiment.
Figure 7:
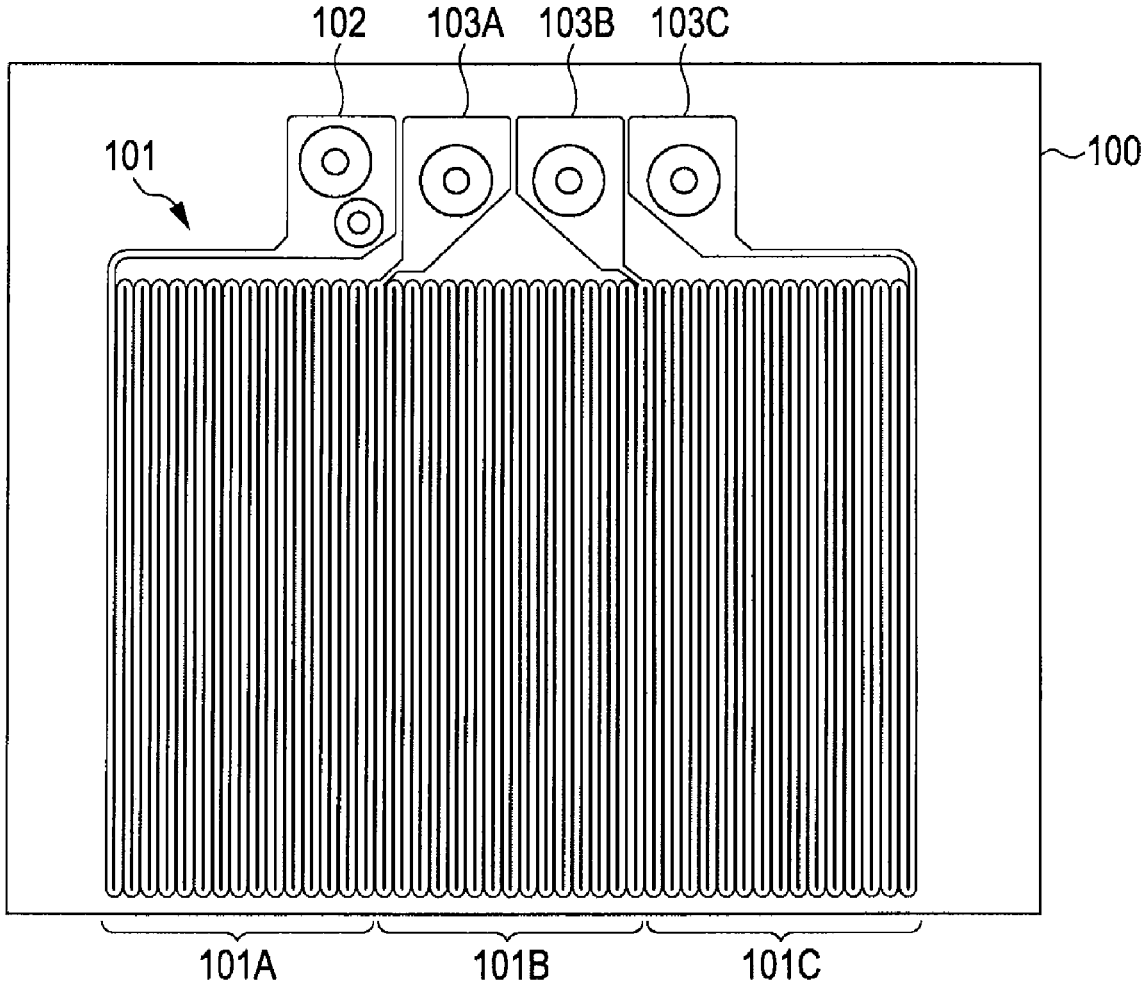
FIG. 7 illustrates an exemplary configuration of a conventional substrate attenuator circuit.

In the second embodiment, the conductive pattern is provided with a larger line width in a portion from the input terminal 20 to an output terminal or output terminals of m portion(s) (m<n) than the line width of the remaining portion, and a k-th (k=1, 2, . . . n−1) stage conductive pattern is disposed to surround the (k+1)-th stage conductive pattern; however, this configuration is only illustrative. For example, as illustrated in FIG. 6, the conductive pattern 11" may have a uniform line width, and a k-th (k=1, 2, . . . n−1) stage conductive pattern may be disposed to surround the (k+1)-th stage conductive pattern.

More specifically, a substrate attenuator circuit may include: a substrate; a linear conductive pattern having a plurality of bends on the substrate; an input terminal disposed at an end of the conductive pattern; and output terminals disposed at n locations (n is an integer of two or larger) of the conductive pattern to provide n resistance values. Where the output terminals of the n portions are disposed in k stages (k=1, 2, . . . n) sequentially from a stage proximate to the input terminal, and where the conductive pattern in a portion from the input terminal to the first stage output terminal is defined as a first stage conductive pattern and the conductive pattern in a portion from a k-th stage output terminal to a (k+1)-th stage output terminal is defined as a (k+1)-th stage conductive pattern, the conductive pattern may have a pattern in which the k-th stage conductive pattern is disposed to surround the (k+1)-th stage conductive pattern.

Further, in the second embodiment, the input terminal 20 is disposed at an approximately central portion of a side of a rectangular region having the conductive pattern 11' formed therein. The first stage conductive pattern 11A' is defined in an order of: the input terminal 20 at the approximately central portion, an inner portion of the rectangular region, an outer peripheral portion of the rectangular region (i.e., an outward path), the outer peripheral portion, and the inner portion (i.e., an inward path). Further, the conductive pattern includes the first stage conductive pattern 11A' and the subsequent second stage conductive patterns 11B' to 11D' that are surrounded by the first stage conductive pattern 11A'. This is however only illustrative. For example, the input terminal 20 may be disposed at an outermost portion of a side of the rectangular region having the conductive pattern 11' formed therein, and the first stage conductive pattern 11A' may be defined in an order of: the input terminal 20 at the outer portion, an outer peripheral portion of the rectangular region, an inner portion of the rectangular region (the path up to here is referred to as an outward path), the inner portion, and the outer peripheral portion (the path up to here is referred to as an inward path). In this case also, the conductive pattern includes the first stage conductive pattern 11A' and the subsequent second stage conductive patterns 11B' to 11D' surrounded by the first stage conductive pattern 11A'.

While there has been illustrated and described what is at present contemplated to be preferred embodiments of the present invention, it will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

What is claimed is:

1. A substrate attenuator circuit comprising:

a substrate;

a linear conductive pattern having a plurality of bends on the substrate;

an input terminal disposed at an end of the conductive pattern; and output terminals disposed at n locations (n is an integer of two or larger) of the conductive pattern to provide n resistance values, wherein the conductive pattern has a larger line width in a portion from the input terminal to m output terminals (m is a positive integer smaller than n) than a line width of the conductive pattern of a remaining portion, the m output terminals being disposed closer to the input terminal of the output terminals of the n locations.

2. The substrate attenuator circuit according to claim 1, wherein m is 1.

3. The substrate attenuator circuit according to claim 1, wherein the output terminals of the n locations are disposed in k stages (k=1, 2, . . . n) sequentially from a stage proximate to the input terminals; the conductive pattern in a portion from the input terminal to the first stage output terminal is defined as a first stage conductive pattern and the conductive pattern in a portion from a k-th stage output terminal to a (k+1)-th stage output terminal is defined as a (k+1)-th stage conductive pattern; and the conductive pattern in the portion from the input terminal to the m output terminals has line widths set such that the k-th stage conductive pattern has a larger line width than the line width of the (k+1)-th stage conductive pattern.

4. The substrate attenuator circuit according to claim 1, wherein the conductive pattern in the portion from the input terminal to the m output terminals has line widths gradually increased in accordance with proximity to the input terminal.

5. The substrate attenuator circuit according to claim 1, wherein the conductive pattern has a plurality of portions bent at an angle of 180 degrees to form a folding pattern.

6. A substrate attenuator circuit comprising:

a substrate;

a linear conductive pattern having a plurality of bends on the substrate;

an input terminal disposed at an end of the conductive pattern; and output terminals disposed at n locations (n is an integer of two or larger) of the conductive pattern to provide n resistance values, wherein the output terminals of the n locations are disposed in k stages (k=1, 2, . . . n) sequentially from a stage proximate to the input terminal; the conductive pattern in a portion from the input terminal to the first stage output terminal is defined as a first stage conductive pattern and the conductive pattern in a portion from a k-th stage output terminal to a (k+1)-th stage output terminal is defined as a (k+1)-th stage conductive pattern; and the conductive pattern has a pattern in which the k-th stage conductive pattern is disposed to surround the (k+1)-th stage conductive pattern.

7. The substrate attenuator circuit of claim 6, wherein the conductive pattern has a plurality of portions bent at an angle of 180 degrees to form a folding pattern.

8. The substrate attenuator circuit according to claim 6, wherein the conductive pattern has a larger line width in a portion from the input terminal to m output terminals (m is a positive integer smaller than n) than a line width of the conductive pattern of a remaining portion, the m output terminals being disposed closer to the input terminal of the output terminals of the n locations.

9. The substrate attenuator circuit of claim 8, wherein m is 1.

10. The substrate attenuator circuit of claim 8, wherein the conductive pattern in the portion from the input terminal to the m output terminals has line widths gradually increased in accordance with proximity to the input terminal.

11. The substrate attenuator circuit of claim 8, wherein the conductive pattern in the portion from the input terminal to the m output terminals has line widths set such that the k-th stage conductive pattern has a larger line width than the line width of the (k+1)-th stage conductive pattern.

* * * * *